United States Patent [19]

Handler et al.

[11] Patent Number: 4,682,698

[45] Date of Patent: Jul. 28, 1987

[54] TOOL HOLDER

[75] Inventors: Milton E. Handler, Northbrook; Richard Sylvan, Glenview; Michael Peterson, Evanston, all of Ill.

[73] Assignee: Hirsh Company, Skokie, Ill.

[21] Appl. No.: 835,938

[22] Filed: Mar. 4, 1986

[51] Int. Cl.[4] ..... A47F 7/00

[52] U.S. Cl. ..... 211/70.6; 211/96

[58] Field of Search ..... 211/70.6, 70.7, 60.1; 211/DIG. 1, 96, 171, 165, 97, 110, 116, 168

[56] References Cited

U.S. PATENT DOCUMENTS

| | | | |
|---|---|---|---|
| 91,559 | 6/1869 | Osborn | 211/96 |
| 190,741 | 6/1961 | Cronheim . | |
| 277,736 | 5/1883 | Ishe | 211/96 X |
| 1,595,699 | 8/1926 | Wilson | 211/96 |

OTHER PUBLICATIONS

"Sears" catalog p. 118.

"Popular Science" p. 60.

Unidentified catalog p. 62.

*Primary Examiner*—Ramon S. Britts

*Assistant Examiner*—Sarah A. Lechok Eley

*Attorney, Agent, or Firm*—Dressler, Goldsmith, Shore, Sutker & Milnamow, Ltd.

[57] ABSTRACT

A tool holder apparatus is provided for holding ferromagnetic hand tools for convenient storage. The apparatus includes a mounting member for being attached to a generally vertical surface and includes a generally elongate support frame extending from the mounting member. The support frame defines at least two oppositely facing sides. The support frame is pivotally mounted to the mounting member to accommodate swinging movement of the support frame for providing access to either of the two sides. A plurality of bar magnets are provided on the support frame for magnetically attracting and holding the hand tools to each side of the support frame.

9 Claims, 5 Drawing Figures

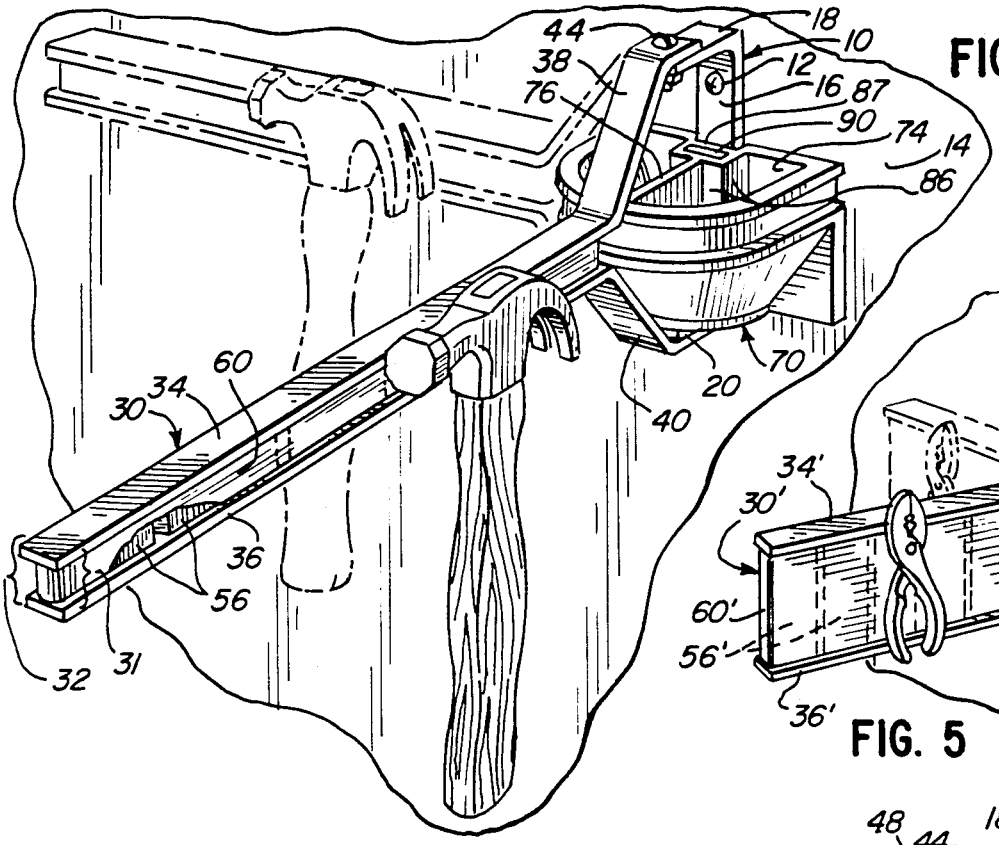
FIG. 1
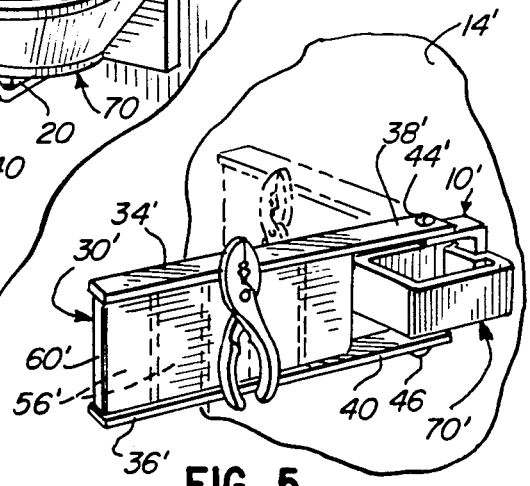
FIG. 5
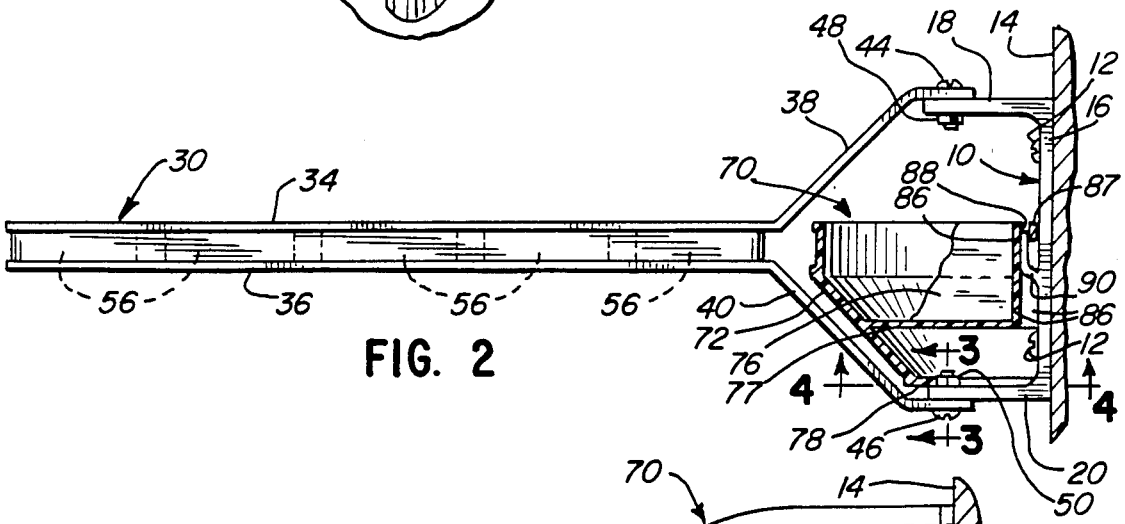
FIG. 2
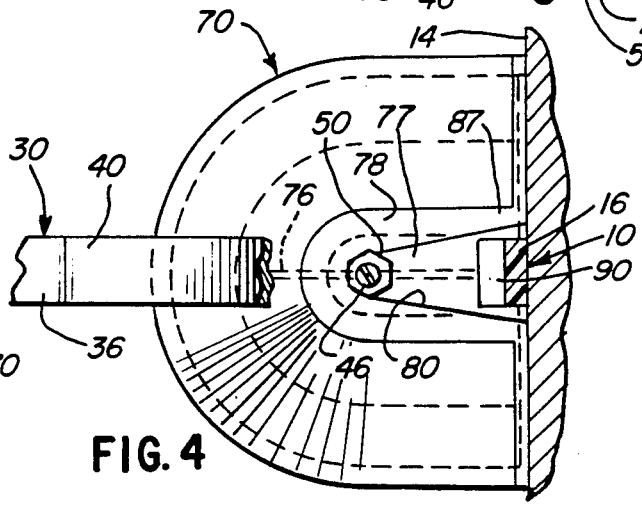
FIG. 4
FIG. 3
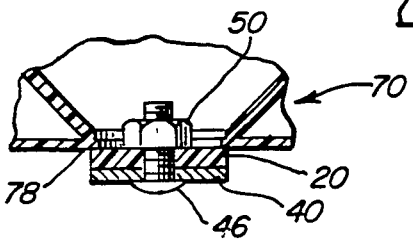

TOOL HOLDER

TECHNICAL FIELD

This invention relates to an apparatus for holding tools, particularly for holding ferromagnetic hand tools for convenient storage.

BACKGROUND OF THE INVENTION AND TECHNICAL PROBLEMS POSED BY THE PRIOR ART

It is well known to provide drawers or tool boxes for holding tools. However, in many cases, it is desirable to provide a storage system for tools wherein the tools can be readily visually inspected and wherein a tool can be removed from storage without interfering with other tools.

It is well known to provide pegboards with hooks and brackets for holding tools. However, such pegboards require a relatively large wall surface area. In some storage situations, sufficient wall space to accommodate a pegboard of the necessary size as not available. Thus, in some situations there is a need for a more compact and efficient tool holding and storage system or mechanism.

The present invention provides a versatile and efficient tool holder that can be employed in relatively small areas having limited access and wall space. The tool holder of the present invention does not require the use of auxiliary hooks or brackets as is necessary with a pegboard tool holding system. Further, a portion of the tool holder of the present invention is movable to various orientations to provide convenient access to the tools and/or a more compact relationship relative to the adjacent wall or walls.

SUMMARY OF THE INVENTION

The apparatus of the present invention holds ferromagnetic hand tools for convenient storage and includes a mounting member for being attached to a generally vertical surface, such as a wall or the like. The apparatus also includes a generally elongated support frame extending from the mounting member. The support frame defines at least two oppositely facing sides.

A mounting means is provided for pivotally mounting the support frame to the mounting member to accommodate swinging movement of the support frame for providing access to either of the two sides. A magnetic means is provided on each side of the support frame for magnetically attracting and holding the hold tools to the support frame.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a perspective view of the apparatus as shown mounted on a vertical surface, such as a wall or the like, and a moved position of the apparatus is shown in phantom by dashed lines;

FIG. 2 is a partial cross-sectional, side view of the apparatus;

FIG. 3 is a greatly enlarged, fragmentary, partial cross-sectional view taken generally along the plane 3—3 in FIG. 2;

FIG. 4 is a greatly enlarged, fragmentary, partial cross-sectional view taken generally along the plane 4—4 in FIG. 2; and FIG. 5 is perspective view of an alternate embodiment of the apparatus.

DESCRIPTION OF THE PREFERRED EMBODIMENTS

While this invention is susceptible of embodiment in many different forms, this specification and the accompanying drawings disclose only some specific forms as examples of the use of the invention. The invention is not intended to be limited to the embodiments so described, and the scope of the invention will be pointed out in the appended claims.

With reference to FIG. 1, the apparatus includes a mounting member or bracket 10 which is adapted to be attached to a generally vertical surface. The mounting member or bracket 10 has a generally planar mounting plate 16 for being disposed against the wall 14. In the embodiment illustrated in FIG. 1, the mounting member or bracket 10 is secured with screws 12 to the wall 14. The bracket has an outwardly projecting upper portion 18 and an outwardly projecting lower portion 20 (FIG. 2) which is spaced below the upper portion 18.

A generally elongate support frame 30 extends from the mounting member 10. The support frame 30 defines at least two oppositely facing sides, a first side 31 and a second side 32 as illustrated in FIG. 1.

The elongate support frame 30 includes two members, a top member 34 and a bottom member 36. The top member 34 has an upwardly angled arm 38 and the bottom member 36 has a downwardly angled arm 40. The support frame 30 can thus be regarded as having a pair of diverging arms at one end, and these diverging arms engage the mounting member 10 as will next be explained.

Specifically, a connecting pin, such as screw 44 is journaled in the upper portion 18 of the mounting member or bracket 10 and in the upper arm 38 of the support frame 30. Similarly, a connecting pin, such as screw 46 (FIG. 2), is journaled in the lower portion 20 of the mounting member or bracket 10 and is also journaled in the downwardly angled arm 40 of the support member 30. As best illustrated in FIG. 2, the screw 44 is retained by a nut 48, and the screw 46 is retained by a nut 50. This arrangement constitutes a mounting means for pivotally mounting the support frame 30 to the mounting member 10 to accommodate swinging movement of the support frame 30 for providing access to either of the two sides 31 and 32 of the support frame 30.

Tools are held to the support frame 30 magnetically. To this end, a magnetic means is provided on each side of the support frame 30 for magnetically attracting and holding the hand tools to the support frame 30. Specifically, a plurality of bar magnets 56 (FIGS. 1 and 2) are disposed between the support frame elongate top member 34 and the support frame elongate bottom member 36. Each bar magnet 56 is disposed along the longitudinal axis of the support frame 30 and is centrally located relative to the width of the support frame top member 34 and bottom member 36. Since the bar magnets 56 are centrally disposed, they function well as magnetic means on each side of the support frame for magnetically attracting and holding the hand tools to each side of the support frame 30.

Preferably, as illustrated for the preferred embodiment in FIG. 1, a cosmetic covering 60 may be provided over the bar magnets 56. The covering 60 may be, for example, a metalized thermoplastic film. Preferably, the thickness of the bar magnets 56 and of the film 60 is less than the horizontal width of the support frame top member 34 and support frame bottom member 36 so that the cosmetic covering 60 is somewhat recessed relative to the sides of the support frame top and bottom members on the support frame sides 31 and 32. Such a structure accommodates placement of a tool against the support frame 30.

The tool holding apparatus also includes a tray 70 disposed on the lower projecting portion 20 of the mounting member or bracket 10. The tray 70 has a configuration to accommodate the movement of the diverging arms 38 and 40 of the support frame 30 during the swinging movement of the support frame 30. The tray 70 may be used to hold small tools, drill bits, screws, nails, and the like.

The tray 70 defines a slanted wall portion 72 (FIG. 2) for being disposed adjacent the support frame downwardly angled arm 40. The tray 70 is opened upwardly and has a generally vertical, planar, rear wall 74 for being disposed adjacent the wall 14 or other vertical surface to which the mounting member or bracket 10 is mounted. The tray may also have one or more internal dividing walls 76 for defining a plurality of receiving compartments.

The tray 70 is preferably removably disposed on the mounting member or bracket 10. To this end, the tray 70 includes a first bottom wall portion 77 and a second bottom wall portion 78 (FIGS. 2–4) that defines a slot or recess means 80 for accommodating the bracket projecting lower portion 20 and the screw 46 and nut 50 of the mounting means.

The tray rear wall 74 also includes an inwardly recessed portion 86 (FIG. 1) having a short cross wall 87 defining a slot 88 (FIG. 4). The mounting member or bracket 10 includes an offset tab 90 for being received in the slot 88. This prevents lateral movement of the tray 70 relative to the bracket 10. The downwardly acting vertical load of the tray 70 is transferred through the tray second bottom wall portion 78 to the bracket projecting lower portion 20. This arrangement results in a strong support for the tray 70 and easily accommodates removal of the tray 70 when desired.

Tools may be held on either or both sides of the tool holder apparatus of the present invention. The support frame 30 may be swung around as necessary to accommodate access to either side. When access to tools on one side of the support frame 30 is not required, the support frame 30 may be swung so that that one side is against the wall. This provides for compact storage of tools.

An alternate embodiment of the tool holder apparatus of the present invention is illustrated in FIG. 5. The apparatus may be mounted to a generally vertical wall 14'. The apparatus includes two generally parallel, spaced-apart support frame members, a top member 34' and a bottom member 36'. Bar magnets 56' are disposed between the top member 34' and the bottom member 36'. The magnets 56' may be covered with a suitable cosmetic cover 60', such as a metalized thermoplastic film.

The top member 34' has an outwardly extending horizontal arm 38', and the bottom member 36' has an outwardly extending horizontal arm 40'. The arms 38' and 40' are adapted to be mounted to a mounting member or bracket 10' which is secured to the wall 14'. Specifically, a connecting pin or screw 44' may be journaled in the arm 38' and in the upper portion of the bracket 10', and a pin or screw 46' may be journaled in the arm 40' and in the lower portion of the bracket 10'. This mounting structure accommodates swinging movement of the support frame 30'.

A tray 70' may be mounted to the bracket 10'. The tray 70' may have a generally square configuration as illustrated. Preferably, the tray 70' is removable.

The distance between the support frame top member 34' and the bottom member 36' in the alternate embodiment of the apparatus illustrated in FIG. 5 may be considerably greater than the corresponding distance between the top member 34 and bottom member 36 of the support frame in the first embodiment illustrated in FIGS. 1–4.

It will be readily observed from the foregoing detailed description of the invention and from the illustrated embodiments thereof that numerous variations and modifications may be effected without departing from the true spirit and scope of the novel concepts or principles of this invention.

What is claimed is:

1. An apparatus for holding ferromagnetic hand tools for convenient storage, said apparatus comprising:

a mounting member for being attached to a generally vertical surface, such as a wall or the like, said mounting member including a bracket having a generally planar mounting plate for being disposed against said wall, said bracket having an outwardly projecting upper portion and an outwardly projecting lower portion spaced below said upper portion, said mounting member also including attachment means for attaching said bracket to said wall;

a generally elongate support frame extending from said mounting member, said support frame defining at least two oppositely facing sides, said support frame having a pair of spaced-apart arms at one end engaging said mounting member, said spaced-apart arms defining between them a receiving region, each said arm extending to one of said bracket projecting portions;

mounting means for pivotally mounting said support frame to said mounting member to accomodate swinging movement of said support frame for providing access to either of said two sides, said mounting means including (1) a connecting pin journaled in said bracket projecting upper portion and one of said arms and (2) a connecting pin journaled in said bracket projecting lower portion and the other of said arms;

a tray removably disposed on said bracket projecting lower portion in said receiving region between said arms, said tray having a configuration to accommodate the movement of said arms during the swinging movement of said support frame; and an elongate magnet carried by said support frame and extending to each side of said support frame for magnetically attracting and holding said hand tools.

2. An apparatus for holding ferromagnetic hand tools for convenient storage, said apparatus comprising:

a mounting member for being attached to a generally vertical surface, such as a wall or the like, said mounting member including a bracket having an outwardly projecting upper portion and an outwardly projecting lower portion spaced below said upper portion;

a generally elongate support frame extending from said mounting member, said support frame defining at least two oppositely facing sides, said support frame having elongate top and bottom members which each extend generally parallel for a first portion of the length of said support frame and which diverge from the parallel orientation as arms which define between them a receiving region at an adjacent second portion of said support frame;

mounting means for pivotally mounting said support frame arms to said mounting member to accommodate swinging movement of said support frame for providing access to either of said two sides;

a tray disposed on said bracket in said receiving region between said support frame arms, said tray having a configuration to accomodate the movement of said diverging arms during the swinging movement of said support frame; and magnetic means on each side of said support frame for magnetically attracting and holding said hand tools to said support frame.

3. The apparatus in accordance with claim 2 in which said tray defines a slanted wall portion for being disposed adjacent one of said support frame diverging arms.

4. The apparatus in accordance with claim 2 in which said tray is removably disposed on said bracket.

5. The apparatus in accordance with claim 2 in which said tray is open upwardly and has a generally vertical, planar rear wall for being disposed adjacent a vertical surface to which said bracket may be mounted.

6. The apparatus in accordance with claim 2 in which said tray includes a bottom wall portion defining a recess means for accommodating said bracket and receiving a portion of said mounting.means.

7. The apparatus in accordance with claim 2 in which said tray has a rear wall with an inwardly recessed portion defining a slot and in which said bracket includes an offset tab for being received in said slot.

8. The apparatus in accordance with claim 2 in which said magnetic means includes at least one bar magnet disposed on said support frame between said top and bottom members in said first portion of the length of said support frame.

9. The apparatus in accordance with claim 2 in which said mounting means includes (1) a connecting pin journaled in said bracket projecting upper portion and one of said arms and (2) a connecting pin journaled in said bracket projecting lower portion and the other of said arms.

* * * * *